US007108446B2

(12) United States Patent
Clark

(10) Patent No.: US 7,108,446 B2
(45) Date of Patent: Sep. 19, 2006

(54) EMERGENCY WARNING DEVICE RAPID DEPLOYMENT SYSTEM

(76) Inventor: Brent A. Clark, 668 S. Freedom Blvd., Provo, UT (US) 84601

( * ) Notice: Subject to any disclaimer, the term of this patent is extended or adjusted under 35 U.S.C. 154(b) by 68 days.

(21) Appl. No.: 10/983,161

(22) Filed: Nov. 4, 2004

(65) Prior Publication Data

US 2005/0199640 A1 Sep. 15, 2005

Related U.S. Application Data

(60) Provisional application No. 60/551,666, filed on Mar. 9, 2004.

(51) Int. Cl.
*B60P 3/00* (2006.01)
*E01F 9/012* (2006.01)

(52) U.S. Cl. ..... 404/9; 414/467

(58) Field of Classification Search ..... 404/6, 404/9; 180/286, 287; 414/467
See application file for complete search history.

(56) References Cited

U.S. PATENT DOCUMENTS

| | | | | |
|---|---|---|---|---|
| 1,228,615 | A | 6/1917 | Stafford | |
| 1,439,101 | A | 12/1922 | Hatcher | |
| 3,732,842 | A | 5/1973 | Vara, Sr. | |
| 3,750,900 | A | 8/1973 | Piercey | |
| 3,952,690 | A * | 4/1976 | Rizzo et al. | 116/63 P |
| 3,967,576 | A | 7/1976 | Soerensen | |
| 4,219,141 | A | 8/1980 | Lovy | |
| 4,552,089 | A | 11/1985 | Mahoney | |
| 4,597,706 | A * | 7/1986 | Michit | 414/788.2 |
| 4,747,515 | A | 5/1988 | Kasher et al. | |
| 4,848,263 | A | 7/1989 | Grimm | |
| 5,054,648 | A | 10/1991 | Luoma | |
| 5,213,464 | A | 5/1993 | Nicholson et al. | |
| 5,244,334 | A | 9/1993 | Akita et al. | |
| 5,375,554 | A | 12/1994 | Yen | |
| 5,490,051 | A | 2/1996 | Messana | |
| 5,525,021 | A | 6/1996 | Larguier | |
| 5,611,408 | A * | 3/1997 | Abukhader | 180/287 |
| 5,839,849 | A * | 11/1998 | Pacholok et al. | 404/6 |
| 5,888,016 | A | 3/1999 | Ahn | |
| 5,908,262 | A | 6/1999 | Ahn | |
| 6,158,948 | A | 12/2000 | Calvert | |
| 6,183,042 | B1 | 2/2001 | Unrath | |
| 6,364,400 | B1 | 4/2002 | Unrath | |
| 6,435,369 | B1 | 8/2002 | Poursayadi | |
| 6,623,205 | B1 * | 9/2003 | Ramirez | 404/6 |
| 6,648,170 | B1 | 11/2003 | Watson | |
| 6,683,532 | B1 | 1/2004 | Peet, II et al. | |
| 6,726,434 | B1 | 4/2004 | Orthaus et al. | |
| 6,758,628 | B1 * | 7/2004 | Curry, Jr. | 404/6 |
| 2002/0154947 | A1 | 10/2002 | Farritor et al. | |
| 2003/0210975 | A1 | 11/2003 | Garcia | |

* cited by examiner

*Primary Examiner*—Raymond Addie
(74) *Attorney, Agent, or Firm*—Thorpe North & Western

(57) ABSTRACT

A safety marker deployment system and method includes a plurality of safety markers removably associated with a motor vehicle in a laterally pre-positioned array substantially corresponding to a desired lateral position on a roadway. The safety markers can be removably disposed in an elongated container mountable to the motor vehicle. Each of a plurality of sequential ejectors is associated with one of the plurality of safety markers to sequentially deploy the safety markers, while the vehicle is moving, in a longitudinal configuration substantially corresponding to a desired longitudinal position on the roadway. The safety markers include a displaceable material disposed in a compliant compartment, and a visual indicator extending upwardly from the compliant compartment.

20 Claims, 9 Drawing Sheets

EMERGENCY WARNING DEVICE RAPID DEPLOYMENT SYSTEM

Benefit is claimed of U.S. Provisional Patent Application Ser. No. 60/551,666, filed Mar. 9, 2004.

BACKGROUND

The present invention relates generally to traffic warning or directional markers, and more particularly, an apparatus and method for rapidly deploying traffic warning or directional markers on a roadway.

Roadway hazards, such as debris, unpredictably stopped vehicles, automobile accidents, and construction, pose a threat to both drivers, and roadway management personnel. This is especially true on roads that have high speed limits and are heavily used by the motoring public. Roadway hazards often emerge suddenly and unexpectedly; forcing drivers to react dangerously and causing great risk to roadway management personnel, such as maintenance, construction or law enforcement workers.

A variety of warning systems have been devised to mitigate the dangers to both drivers and roadway management personnel. The two most commonly used traffic warning devices are traffic safety markers, such as cones or barrels, and warning lights mounted to a motor vehicle. Both of these devices are widely used to warn drivers and route traffic around temporary impending hazards.

Traffic safety markers, such as cones or barrels, are highly visible and can be placed on a roadway significantly ahead of a hazard to efficiently direct traffic around the hazard. Placement of the traffic safety markers, however, is often hazardous in itself, especially on high-speed, busy roadways, such as interstate freeways, where manual placement creates a risk of personal injury, and may take valuable time away from attending to accidents. Some traffic safety markers can be placed in a line on the roadway by use of automated deployment devices mounted to a vehicle, but the physical size and slowness of these devices make them impractical for temporary localized roadway hazards.

Warning lights mounted to maintenance, construction and law enforcement vehicles allow roadway management personnel to warn drivers and direct traffic around localized roadway hazards without risking personal injury. These devices, however, provide warning only in the immediate vicinity of the vehicle they are mounted to, and can only be placed significantly ahead of an impending hazard by placing a vehicle away from the site of the hazard.

SUMMARY

It has been recognized that it would be advantageous to develop a safety marker deployment system to rapidly deploy safety markers from a moving motor vehicle substantially in predetermined lateral and longitudinal arrays.

Briefly, and in general terms, the invention is directed to a system and method for deploying safety markers from a moving vehicle in predetermined lateral and longitudinal arrays.

In accordance with one aspect of the present invention, the system includes a plurality of safety markers is removably associated with a motor vehicle in a laterally pre-positioned array substantially corresponding to a desired lateral position on a roadway. A plurality of sequential ejectors is each associated with one of the plurality of safety markers to sequentially deploy the safety markers, while the vehicle is moving, in a longitudinal configuration substantially corresponding to a desired longitudinal position on the roadway. The safety markers can be removably disposed in at least one container mountable to the vehicle.

In accordance with another aspect of the present invention, the method for directing traffic or warning drivers on a roadway includes loading a plurality of safety markers with respect to a vehicle in a laterally pre-positioned array substantially corresponding to a desired lateral position on a roadway. The vehicle is driven on the roadway. A plurality of sequential ejectors, each associated with one of the markers, is actuated to sequentially eject the safety markers, while the vehicle is moving, behind the vehicle in a predetermined lateral and longitudinal configuration with respect to the roadway. Again, the safety markers can be loaded into a container mounted to the vehicle.

In accordance with another aspect of the present invention, the safety markers include a displaceable material disposed in a compliant compartment. A visual indicator extends upwardly from the compliant compartment.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
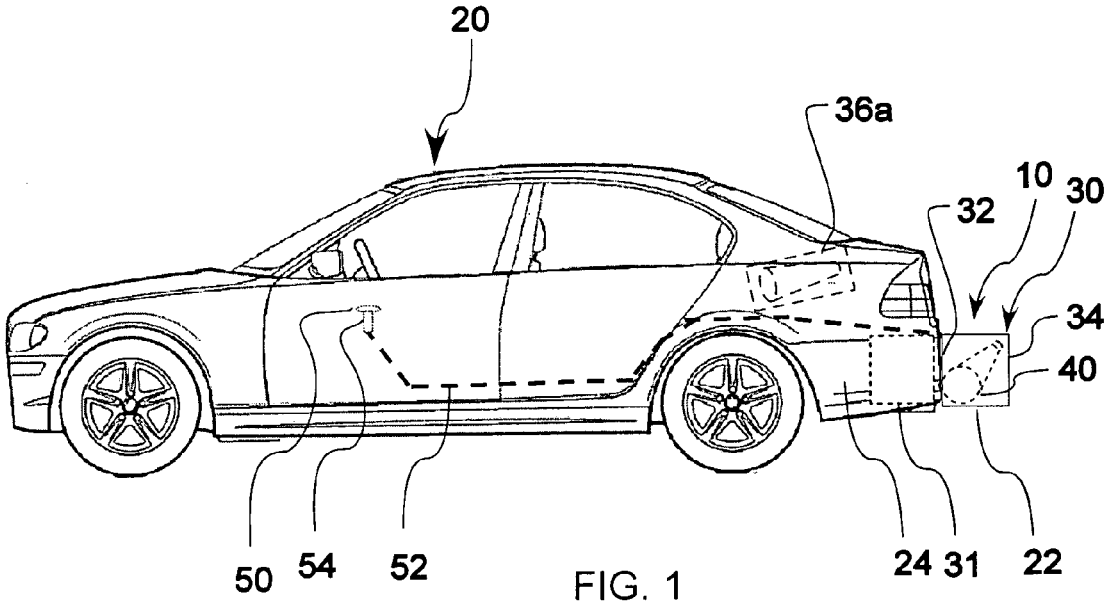
FIG. 1 is a side view of a safety marker deployment system in accordance with an embodiment of the present invention shown mounted on a vehicle.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLARY EMBODIMENT(S)

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention. The following detailed description and exemplary embodiments of the invention will be best understood by reference to the accompanying drawings, wherein the elements and features of the invention are designated by numerals throughout.

The present invention is directed to a safety marker deployment system that rapidly deploys safety markers from a moving motor vehicle substantially in predetermined lateral and longitudinal arrays. Specifically, the safety marker deployment system can include one or more containers that can be mounted to a motor vehicle, and that holds several safety markers. The safety markers are laterally pre-positioned with respect to the vehicle, or in the container, and sequentially ejected from the container so that they land on the roadway behind the vehicle in a pattern that diverts traffic around the safety markers and any obstacle in front of the safety markers, such as the vehicle. The safety markers are weighted such that when they hit the roadway after being ejected they will orient into an upright position. Additionally, the safety markers are designed to absorb impact energy so that they will come to rest soon after impact with the roadway, without significant bouncing or travel away from the prescribed diversionary pattern. Because of their self-orienting and impact absorbing design, the safety markers can be ejected from a stationary or moving vehicle.

As illustrated in FIGS. 1–4, 7 and 8, a safety marker deployment system 10 in accordance with an exemplary embodiment of the present invention is shown, mounted to a motor vehicle 20, for deploying or ejecting safety markers on a roadway 21 (FIG. 4) in a predetermined lateral and longitudinal configuration while the vehicle is moving. The vehicle 20 can be a law enforcement vehicle, such as a police cruiser, as shown; an emergency vehicle, such as an ambulance, a fire engine, an emergency response vehicle; a road construction vehicle or road maintenance vehicle; etc. In addition, the vehicle 20 can be a sedan or passenger vehicle, as shown, a truck, tractor trailer rig, van, motorcycle, etc. Law enforcement, emergency response and road construction and maintenance are examples of fields that can benefit from the safety marker deployment system. It will be appreciated that a similar configuration can be used for other vehicles, such as watercraft, snowcraft, etc.

Figure 2:
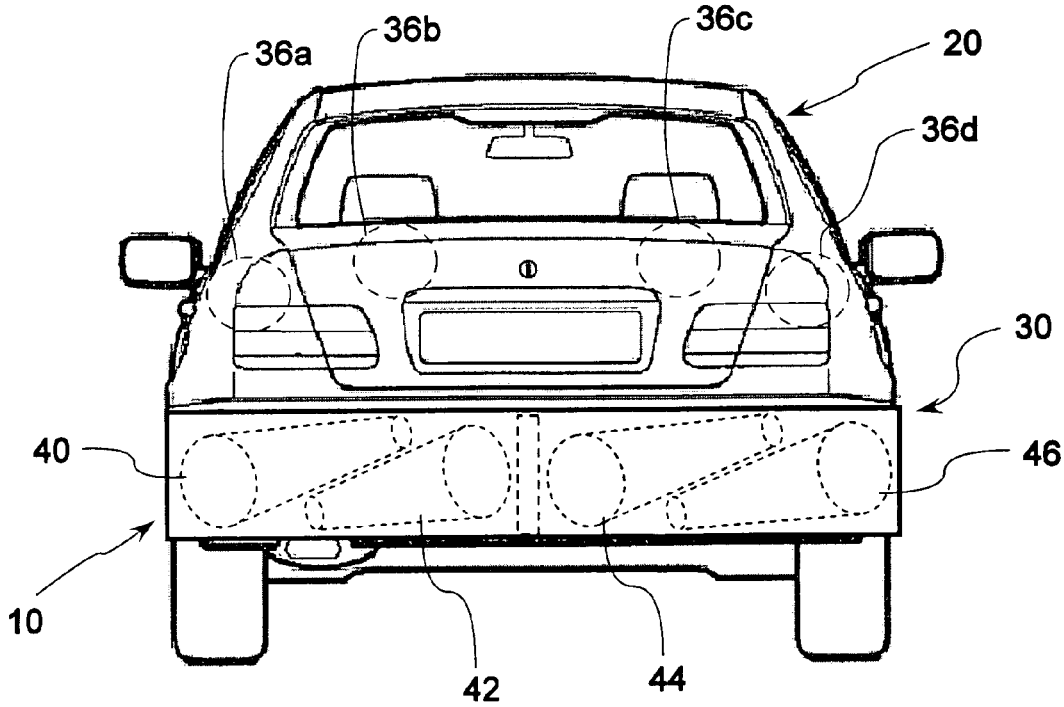
FIG. 2 is a rear view of the safety marker deployment system of FIG. 1 shown mounted on the vehicle.
Figure 4:
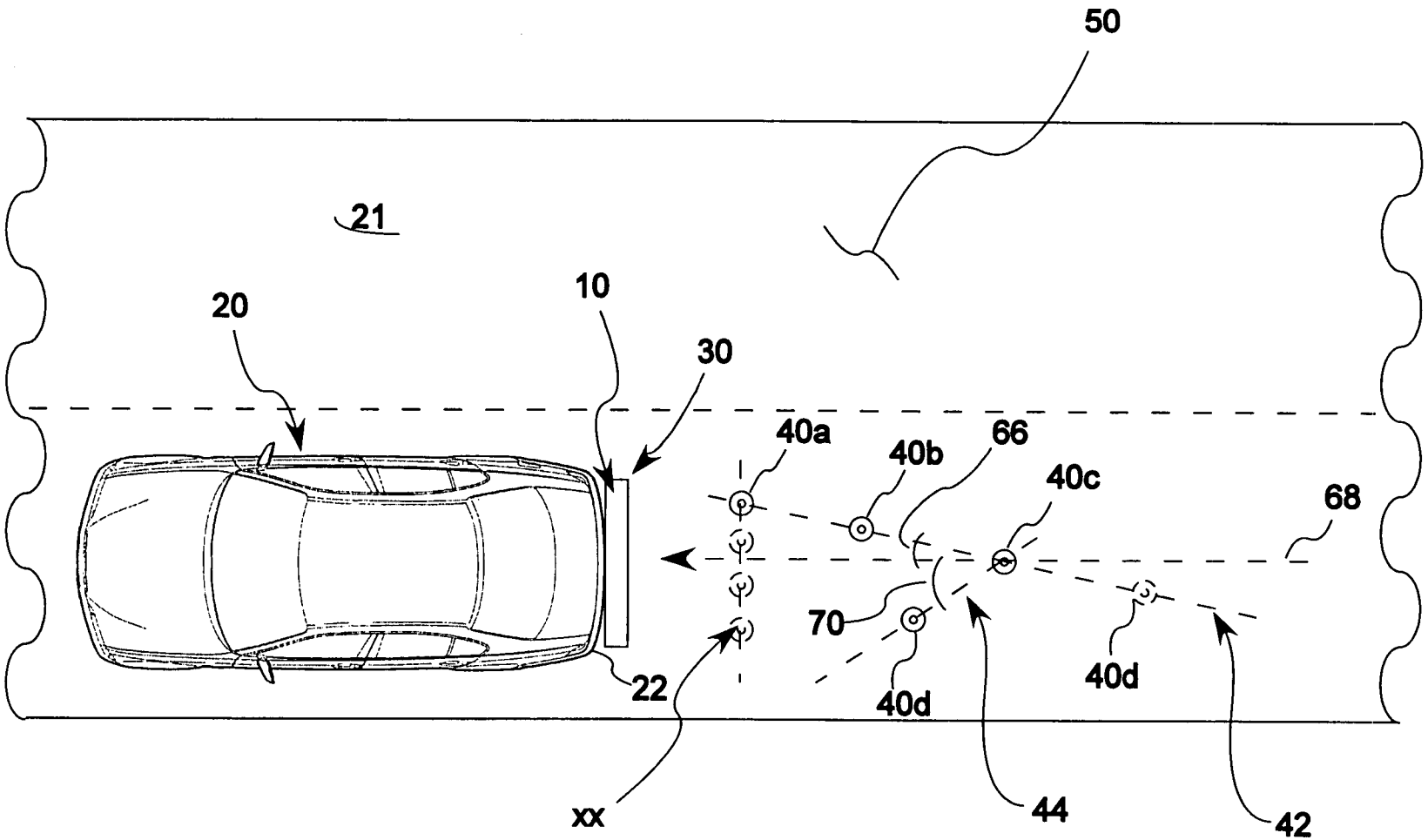
FIG. 4 is a top view of the safety marker deployment system of FIG. 1 shown mounted on the vehicle and deploying safety markers on a roadway.

The safety marker deployment system 10 can include an elongated container 30 mounted to the vehicle 20. For example, the container 30 can be mounted to the rear bumper 22 of the vehicle 20, as shown in FIGS. 1, 2 and 4. The container 30 can be mounted behind the bumper or to an exterior of the bumper, as shown. Alternatively, the container 30 can be mounted under the bumper. As another example, a container 31 can be incorporated into the bumper 22 of the vehicle, as indicated by phantom lines in FIG. 1. Thus, the bumper 22 can form all or a portion of the container 31. As another example, the container 31 can be mounted inside the vehicle, again as shown in phantom lines in FIG. 1. For example, the container can be mounted in the trunk 24 of the motor vehicle, so that the container 31 is hidden from view and does not interfere with the bumper. As another example, the container can be mounted underneath the vehicle.

Figure 7:
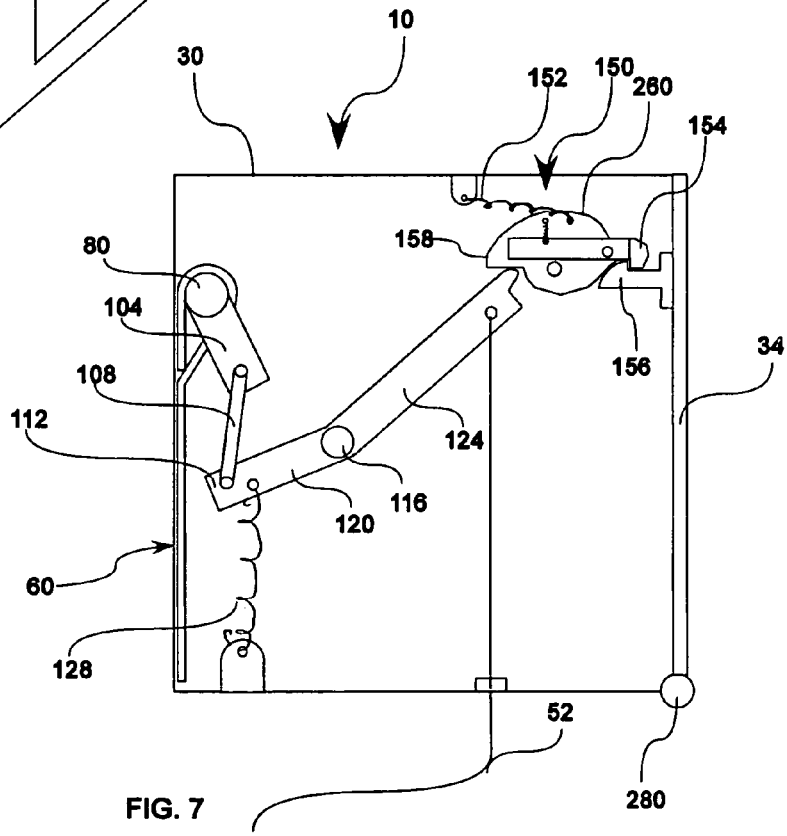
FIG. 7 is a schematic cross-sectional side view of the safety marker deployment system of FIG. 1 shown in a closed configuration.
Figure 8:
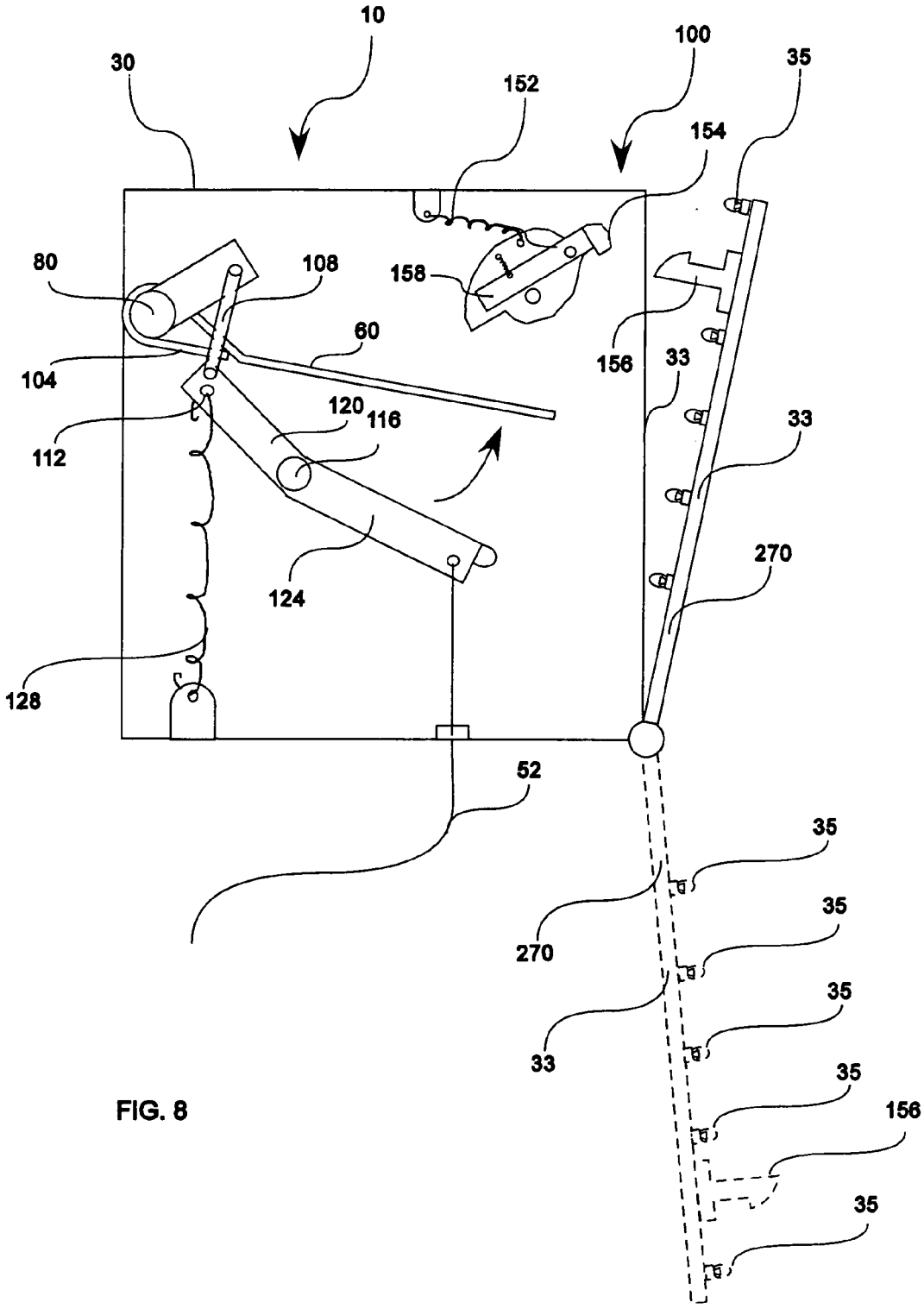
FIG. 8 is a schematic cross-sectional side view of the safety marker deployment system of FIG. 1 shown in an open configuration.

The elongated container 30 can have a longitudinal axis that is oriented laterally, or side-to-side, with respect to the vehicle 20 and/or roadway 21. The container 30 can include a rear wall 32 that can be used to mount the container to the bumper. In addition, the container 30 can include an opening 33 (FIG. 8) through which the safety markers can exit the container, as explained below. Furthermore, the container 30 can include a lid 34 or flap movably coupled to the container 30 over the opening 33 to selectively cover the opening and resist unintended release of the safety markers. For example, the lid 34 can be pivotally coupled to the container. The lid 34 can be pivotally coupled at its bottom edge, and configured to open in a downward direction to take advantage of gravity in opening the container. Alternatively, the container can open in another direction, and can include spring assists. The lid 34 can move or pivot between a closed position over the opening, as shown in FIGS. 1 and 7, and an open position exposing the opening, as shown in FIG. 8. The lid can also include reflective tape and/or LED lighting 35 on the inside or along its edges that is displayed when the lid is opened providing additional warning to nearby vehicles.

A plurality of safety markers 40 is removably disposed in the container 30. For example, the container can include four safety markers 40*a*–*d*, as shown. The safety markers 40 are arrayed laterally in the container in a laterally pre-positioned array corresponding to a desired lateral position on the roadway. Thus, the safety markers are substantially pre-positioned in the container to correspond to a subsequent desired lateral position on the roadway. The safety markers 40 can have a size or configuration that is vertical, or higher than wider. Thus, the safety markers 40 can be disposed in the container 30 on their side, or lying down. The safety markers 40 can be sequentially deployed from the container 30 while the vehicle is moving in a longitudinal configuration substantially corresponding to a desired longitudinal position on the roadway. Thus, the safety markers are deployed in a predetermined lateral and longitudinal configuration. For example, the safety markers 40*a*–*d* can be sequentially deployed from right to left while the vehicle is moving to obtain a substantially linear configuration oriented transverse to the roadway at an acute angle, indicated by 42 in FIG. 4. As another example, the safety markers 40*a*–*d* can be sequentially deployed from the middle to the sides while the vehicle is moving to obtain a substantially v-shaped configuration with a pair of linear configuration oriented transverse to the roadway and one another at an acute angle, indicated by 44 in FIG. 4. It will be appreciated that the container can be configured to hold more or fewer than four safety markers, and that the safety markers may vary in size.

The safety marker deployment system 10 can be remotely controlled or operated from within the vehicle, such as by the driver. For example, a handle 50 or other actuator can be disposed within the vehicle, and can be operatively coupled to an actuator cable 52 that extends from the handle in the vehicle to the container 30. When the handle is pulled, the actuator cable actuates the safety marker deployment system. A mounting bracket 54 can be operatively coupled to the handle and attached to the motor vehicle, and allows the operator of the motor vehicle to operate the handle, thereby ejecting the safety markers while sitting in the driver seat of the vehicle. It will be appreciated that, while the actuator is generally shown as a handle, other suitable actuation devices may also be used. For example the actuator could be an electric switch, a microprocessor relay, a pneumatic switch, a hydraulic lever arm, or an electro-hydraulic switch. In addition, the system can include an electrical cable. Furthermore, the system can be remotely actuated by wireless signals, such as a signal from a radio transmitter, infrared transmitter, acoustic transmitter, etc.

Figure 3:
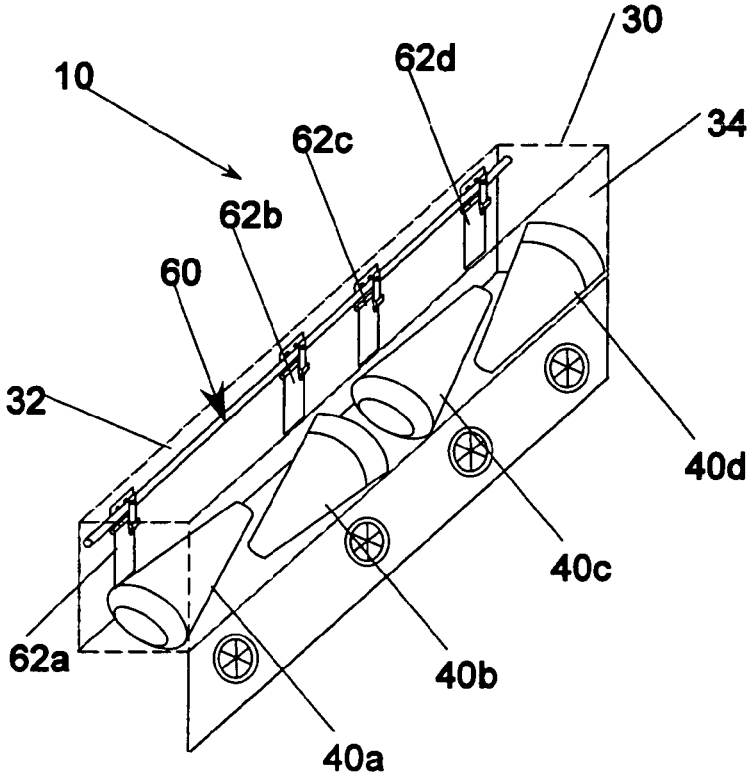
FIG. 3 is a perspective schematic view of the safety marker deployment system of FIG. 1.

Referring to FIG. 3, a perspective schematic view of the safety marker deployment system is shown. The safety marker deployment system 10 includes an ejector system 60 to sequentially deploy or eject the safety markers from the container. The ejector system can include a plurality of sequential ejectors 62*a–b*, each associated with one of the plurality of safety markers 40*a–d* to sequentially deploy the safety markers from the container. The ejector system 60 and/or ejectors 62*a–d* can be mounted to the rear wall 32 of the container 30. When the ejector system 60 is actuated, the ejectors sequentially actuate to deploy the safety markers while the vehicle is moving. Because the safety markers 40 are deployed or ejected sequentially, they will form a longitudinal configuration substantially corresponding to a desired longitudinal position on the roadway. Reference to longitude generally indicates the direction of travel of the motor vehicle, or in other words the direction associated with the front to back of the motor vehicle. Thus, longitude generally corresponds to the roadway. The sequential deployment of the safety markers in combination with the lateral pre-positioning of the safety markers in the container result in a predetermined lateral and longitudinal configuration of safety markers on the roadway behind the motor vehicle in a desired configuration, such an linear angled, v-shaped, etc.

Referring to FIG. 4, the motor vehicle 20 is shown on the roadway 21 with the safety markers 40 ejected from the container while the motor vehicle is in motion. The safety markers 40*a–d* can be deployed in a v-shaped pattern 44 formed when middle safety marker 40*c* is ejected first, then end safety marker 40*d* is ejected, followed by intermediate safety marker 40*b*, and end safety marker 40*a* is ejected last. In this ejection sequence, the three safety markers 40*a–c* line up in a first linear configuration oriented at an oblique angle 66 with respect to the direction of travel 68 of the motor vehicle or longitude, and another plurality of safety markers 40*c* and *d* line up in a second linear configuration oriented at another different oblique angle 70 with respect to the direction of travel 68, and the first linear configuration. An alternate safety marker deployment pattern is shown in which all of the safety markers 40*a–d* line up a single linear configuration oriented at oblique angle 66 with respect to the direction of travel 68 of the vehicle. Another alternate safety marker deployment pattern 64 is shown where all of the safety markers 40*a–d* form a line perpendicular to the direction of travel 68 of the vehicle. This last pattern occurs when the safety markers are deployed simultaneously, or while the vehicle is not moving. It will be appreciated that the linear configurations or v-shaped configurations described above are substantially linear or substantially v-shaped because the safety markers will be deployed while the vehicle is moving.

Figure 5:
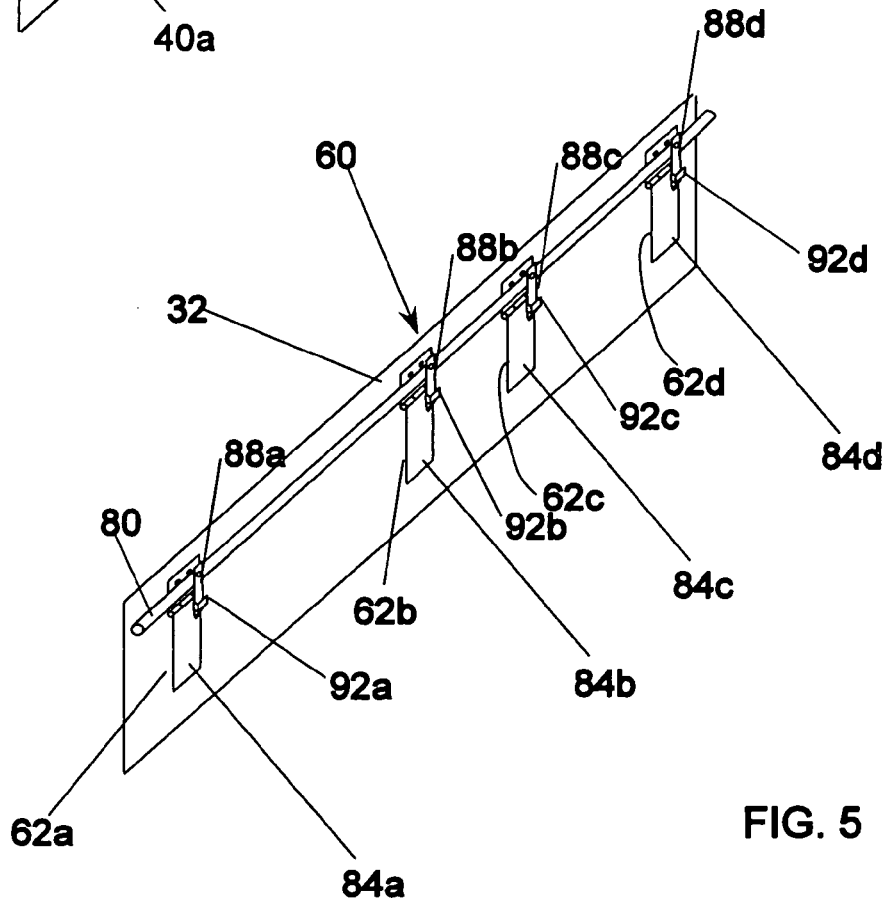
FIG. 5 is a partial perspective view of the safety marker deployment system of FIG. 1.
Figure 6:
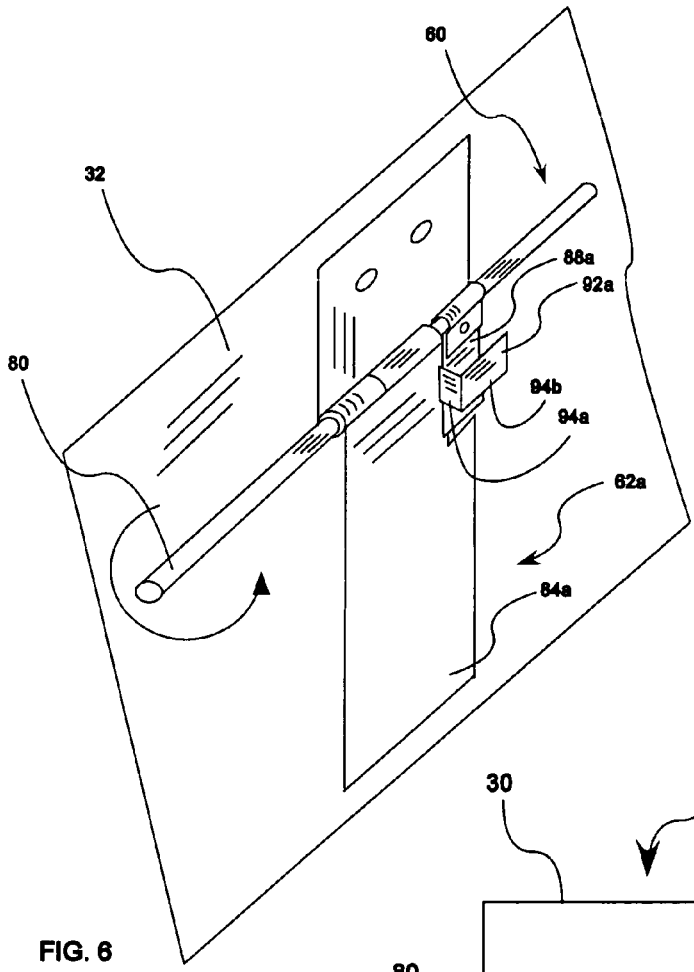
FIG. 6 is a partial perspective view of the safety marker deployment system of FIG. 1.

Referring to FIGS. 5 and 6, the sequential ejector system 60 and/or ejectors 62*a–d* can include a pivot rod 80 pivotally coupled to the rear wall 32 of the container 30, and a plurality of flaps 84*a–d* spatially disposed along the length of the rear wall 32 of the container 30. The pivot rod 80 is pivotable about the pivot rod's longitudinal axis and has a plurality of fingers 88*a–d* attached to, and pivotable with the pivot rod. Flaps 84*a–d* can be hingedly connected to the rear wall 32 of the container 30. Thus, each flap can include a flap portion and a hinge portion pivotally coupled together by a pivot with the hinge portion attached to the rear wall and the flap portion free to pivot about the pivot. In addition, the flaps can include tabs 92*a–d* attached to each one of the flaps and positioned to be engaged by one of the fingers 88*a–d* as the pivot rod rotates. Thus, as the pivot rod 80 pivots or rotates, the fingers 88*a–d* also pivot or rotate into contact with the tabs 92*a–d*. As the pivot rod 80 and fingers 88*a–d* continue to pivot or rotate, the fingers 88*a–d* move the tabs 92*a–d* and cause the flaps 84*a–d* or flap portions to pivot. As the flaps 84*a–d* or flap portions pivot, they contact the safety markers 40, causing them to exit the container.

Referring to FIG. 6, each tab, represented by tab 92*a*, has an extension portion 94*a* and a finger engagement portion 94*b*. The extension portion of each tab has a different length so that the fingers will engage each tab sequentially, or at a different time as the pivot rod rotates. Thus, the distance of each tab from the flap portion allows the flaps to be engaged in a desired sequence as the pivot rod rotates.

Referring to FIGS. 7 and 8, a sequential ejector engagement mechanism 100 is shown that operatively couples the actuator cable 52 to the pivot rod 80 and lid 33. A pivot rod lever 104 can be coupled to the pivot rod 80 and movable or pivatable with the pivot rod.

A main lever 112 can be pivotally coupled in the container, such as to a side wall, and pivotable about a pivot 116. The main lever 112 can be angled and can have a pivot rod lever engagement portion 120 and an opposite lid latch engagement portion 124. The main lever 112 can rotate or pivot about the pivot 116, and can have an unengaged positioned, wherein the main lever does not engage the engagement rod on the pivot rod lever, as shown in FIG. 7. A spring 128 or other biasing means can connect the pivot rod lever engagement portion 120 of the main lever 112 to the container. The spring 128 acts as a biasing device between the main lever and the container, and biases the main lever to the unengaged position. It is of course understood that other biasing configurations are possible. An engagement link 108 can be pivotally coupled between the main lever 112 and the pivot rod lever 104.

The actuator cable 52 can be connected to the lid latch engagement portion 124 of the main lever 112. When the actuator handle 50 is pulled, the cable 52 is pulled, causing the main lever 112 to pivot. As the main lever 112 pivots, the pivot rod lever engagement portion 120 moves the engagement link 108 which, in turn, pivots the pivot rod lever 104, thus pivoting the pivot rod 80 and ejecting the safety markers.

When the actuator handle 50 is pulled, the actuator cable 52 pulls the lid latch engagement portion 124 of the main lever 112 and the main lever rotates about the pivot 116 so that the pivot rod lever engagement portion 120 moves the engagement link 108 which, in turn pivots the pivot rod lever 104 and rotates the pivot rod 80. When the pivot rod 80 rotates, the fingers 88*a–d* attached to the pivot rod also rotate and contact the tabs 92*a–d* on the flaps 84*a–d*, thereby raising the flaps. As the flaps are rotated, they contact the safety markers 40*a–d* and eject them from the container 30 and onto the roadway 21.

The system 10 can also include a lid latch mechanism 150 for maintaining the lid 33 in the closed configuration, and/or releasing the lid 33 to open the container 30. The lid latch engagement portion 124 of the main lever 112 can engage the lid latch mechanism 150 when biased into the unengaged position, thereby keeping the lid 33 closed. The lid latch mechanism 150 can have a hook 154 engaging a hook 158 on the lid 33. In addition, the lid latch mechanism 150 can include a main lever engagement end 158. The lid latch mechanism 150 can be pivotally coupled to the container, such as a side wall. A spring 162 can be coupled between the container and the mechanism 150 to bias the hook 154 away from the hook 158 on the lid. The main lever 112, however, can have the lid latch engagement portion 124 engaging the main lever engagement end 158 to prevent the mechanism for pivoting. When the actuator handle 50 is pulled, the cable 52 is pulled, causing the main lever 112 to pivot. As the main lever 112 pivots, the lid latch engagement portion 124 dis-engages from the main lever engagement end 158, allowing the mechanism 150 to pivot and the lid to open as shown in FIGS. 3 and 8.

The flaps 80*a–d* and/or ejector system 60 is one example of means for sequentially ejecting safety markers from the container and/or sequentially deploying safety markers onto the roadway. It will be appreciated that other suitable ejector mechanisms can be used, such as electronic solenoids, pneumatic solenoids, hydraulic rams, pneumatic rams, trap doors, magnetic switches, gravity assist hooks, and a burst of localized compressed gas.

Figure 9:
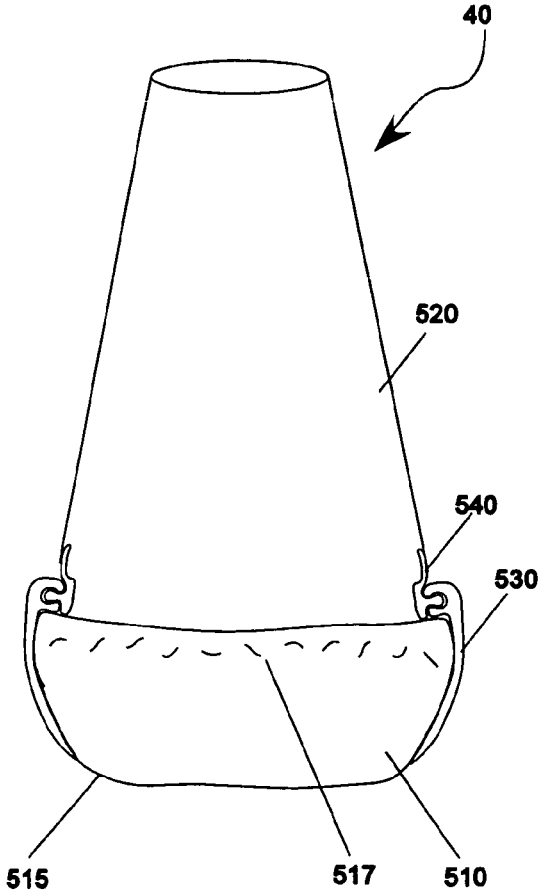
FIG. 9 is a side view of a safety marker in accordance with an embodiment of the present invention.

Referring to FIG. 9, the safety marker 40 is shown in one exemplary embodiment. The safety marker 40 can include a base 510 and a visual indicator 520 extending upwardly from the base. As described in greater detail below, the safety marker 40 advantageously can be self-righting and energy absorbent to resist displacement when deployed. The visual indicator 520 can provide a visual surface, and thus can include bright or neon colors, light reflecting material, etc. The base 510 can be connected to the visual indicator 520 by a tongue and groove clip that extends around at least a portion of the circumference of the base and the visual indicator. The groove portion of the clip is attached near the top end of the base. The tongue portion of the clip is attached near the bottom end of the visual indicator, and allows the visual indicator to be attached or removed from the base. Thus, the visual indicator can replaced with a different visual indicator. This allows the base to be used with multiple styles of different visual indicators that can be interchangeable on the base.

The base 510 can be weighted, or heaver than the visual indicator. For example, the base 510 can form a compartment or pocket filled with a relatively heavy material. In addition, the base 510 can have a curved bottom perimeter edge, or rounded bottom. The rounded bottom and heavy material cause the safety marker 40 to self-right, or orient itself so that the visual indicator extends substantially vertically, even when the safety marker is deployed from a moving vehicle.

In addition, the base 510 can be configured to absorb energy on impact. Thus, the base 510 can include a compliant compartment or pocket 515 filled with a displaceable material 517. Thus, as the safety marker 40 contacts the roadway 21, the compliant compartment 515 and displaceable material 517 absorb the energy of the impact, and resist bouncing or further lateral displacement of the safety marker. It has been found that the safety marker tends to slide in a substantially longitudinal direction, without substantially displacing laterally. Thus, the safety markers tend to deploy substantially in the desired configuration. The base can be formed of a leather, canvas or vinyl material partially filled with sand or the like.

The visual indicator can be conically shaped and can be traffic cone orange in color. The visual indicator can be a compliant, substantially conical compartment filled with a flexible and resilient material that is lighter in weight than the base.

It will be appreciated that, while the visual indicator is generally shown as being constructed in conical shape, other suitable configurations, such as a cylindrical or square tube, may also be used. Those skilled in the art will recognize that a variety of materials could be used in the construction of the visual indicator of the present invention. For example, the cone could be made of leather, molded rubber, compliant foam, rigid foam, a pressed cardboard cone, or a biodegradable material cone could be used.

Figure 11:
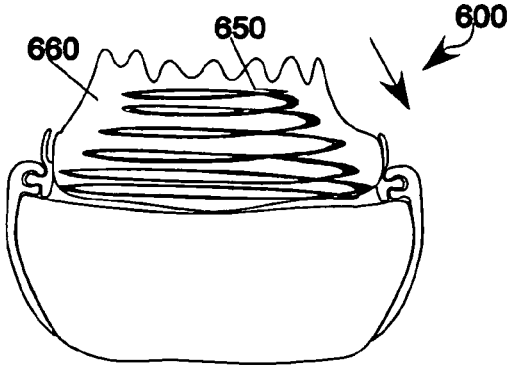
FIG. 11 is a cross-sectional side view of the safety marker of FIG. 10, shown in a compressed configuration.
Figure 10:
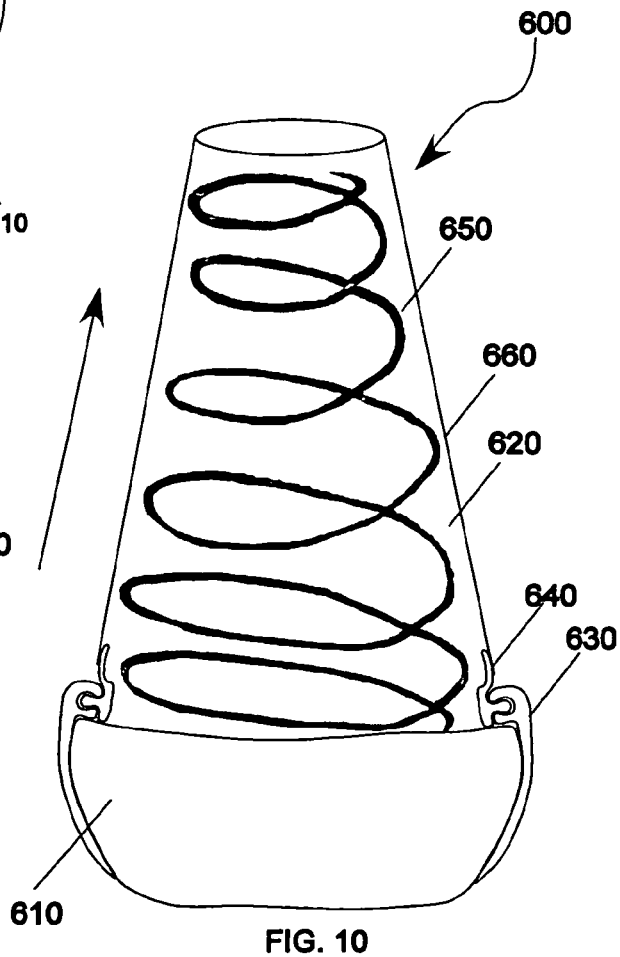
FIG. 10 is a cross-sectional side view of another safety marker in accordance with an embodiment of the present invention, shown in an extended configuration.

Referring to FIGS. 10 and 11, an alternative embodiment of a safety marker 600 is shown. Specifically, the safety marker 600 can have a substantially conical visual indicator 620 that contains a conical compression spring 650 covered in a flexible material 660. Thus, the visual indicator 620 can have an extended or expanded configuration, as shown in FIG. 10, and a collapsed or compressed configuration, as shown in FIG. 11. This embodiment provides the added advantage of being able to store a significant number of safety markers within the container 30 shown in FIG. 1.

Figure 12:
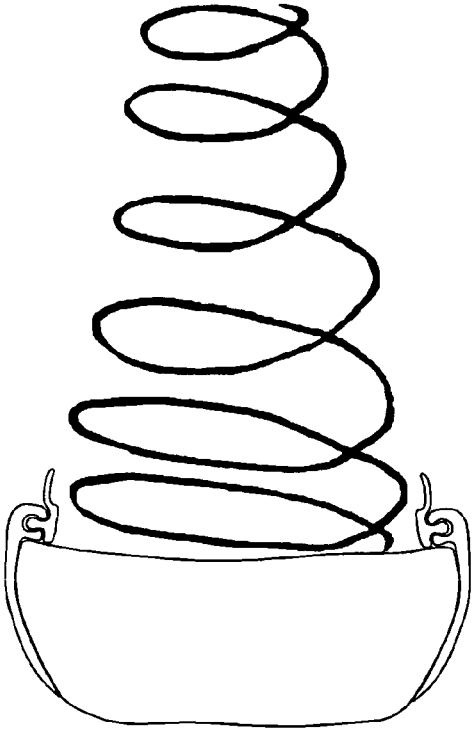
FIG. 12 is a cross-sectional side view of another safety marker in accordance with an embodiment of the present invention, shown in an extended configuration.

Referring to FIG. 12, an alternative embodiment of a safety marker 700 is shown. Specifically, the safety marker 700 can have a substantially conical visual indicator that is only a conically shaped compression spring. The compression spring in this embodiment is colored a bright warning color such as traffic cone orange. The compression spring can be compressed similar to the embodiment described in FIGS. 10 and 11.

Figure 14:
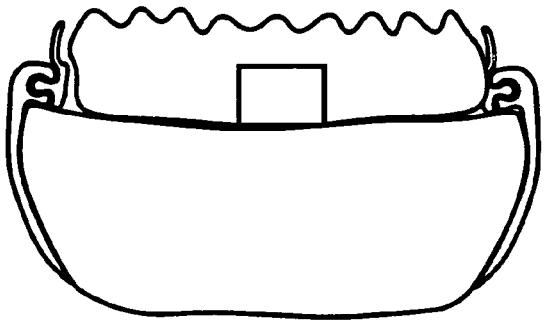
FIG. 14 is a cross-sectional side view of the safety marker of FIG. 10, shown in a compressed configuration.
Figure 13:
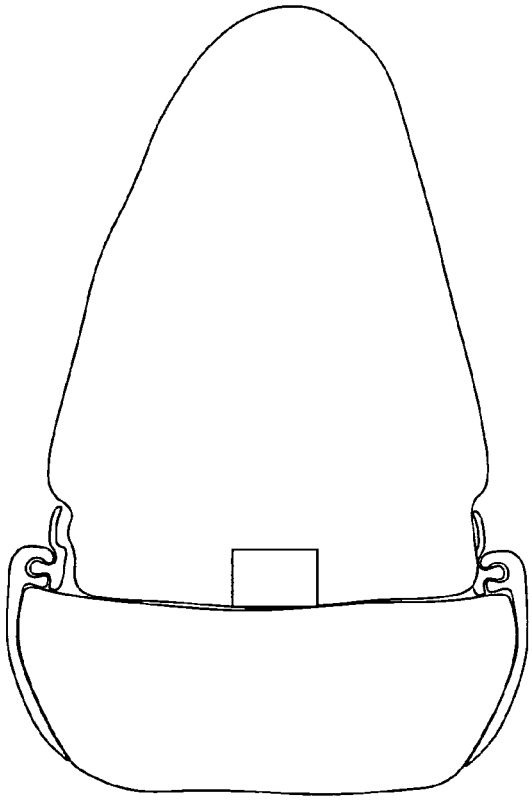
FIG. 13 is a cross-sectional side view of another safety marker in accordance with an embodiment of the present invention, shown in an extended configuration.

Referring to FIGS. 13 and 14, an alternative embodiment of a safety marker 800 is shown. Specifically, the safety marker 800 can have a substantially conical visual indicator 820 made of an inflatable balloon or bladder. A compressed gas cartridge 870 is remotely activated at the time the safety marker is ejected to inflate the balloon or bladder. It will be appreciated that the balloon of this embodiment could be inflated by a variety of compressed gas sources. For example, a compressible gas source could be mounted on the motor vehicle and connected to the balloon safety marker so that compressed gas is allowed to inflate the balloon immediately prior to or after ejection from container 30. FIG. 14 shows the inflatable balloon in a substantially un-inflated and collapsed state.

Figure 15:
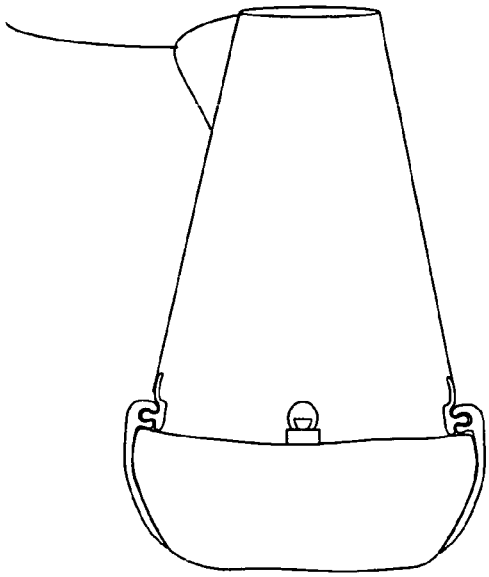
FIG. 15 is a cross-sectional side view of another safety marker in accordance with an embodiment of the present invention, shown in an extended configuration.

Referring to FIG. 15, an alternative embodiment of a safety marker 900 is shown. Specifically, the safety marker 900 has a substantially conical visual indicator 920 containing an illumination device 980 which will illuminate the visual indicator. The illumination device 920 may be a battery-operated light that turns on when the cone is ejected from the container 30. Alternatively, the illumination device can be a self-igniting flare that ignites upon contact with the roadway. For example, the flare can include a friction igniting flare that is operatively coupled to a bottom surface of the base.

The system can also include a tether cable 990, which can be attached between the container and the safety marker, and allows the user to retrieve the cones while remaining near the motor vehicle. It is of course understood that the tether cable could be used with any of the embodiments described above. In addition, the system can include a take-up reel to reel-in the safety markers after use.

It will be appreciated that other alternative embodiments of safety markers exist which facilitate deployment or retrieval of the safety markers. For instance, a safety marker could be made of a combustible material and contain an explosive charge such that when the safety marker is no longer needed the charge can be exploded, thus destroying the safety marker. Another embodiment envisions a safety marker with remotely controlled motorized wheels, coupled to the compliant compartment base, and a radio signal receiver, operatively coupled to the wheels so that the safety marker can be remotely driven to a desired location after ejection from the container. Another embodiment envisions a floating safety marker that can be deployed in water behind a water traveling vehicle such as a boat or jet ski. Another embodiment envisions a safety marker with spring loaded, retractable, lighted arms that are compressed when the safety marker is loaded in the container and swing out after deployment thereby providing a sizable lighted warning marker.

Figure 16:
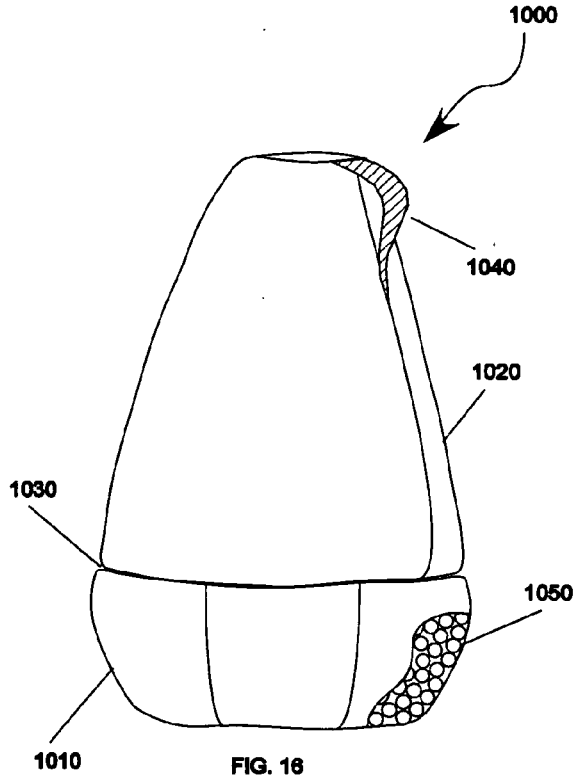
FIG. 16 is a side view in partial cross-section of another safety marker in accordance with an embodiment of the preset invention.

Referring to FIG. 16, an alternative embodiment of a safety marker 1000 is shown. Specifically, the safety marker 1000 can have a substantially conical visual indicator 1020 that is vinyl filled with a foam material. The base 1010 is leather, is filled with steel shot 1050, and is sewn 1030 onto the visual indicator portion so that it is not removable. A small handle 1040 is attached near the top of the visual indicator.

Figure 17:
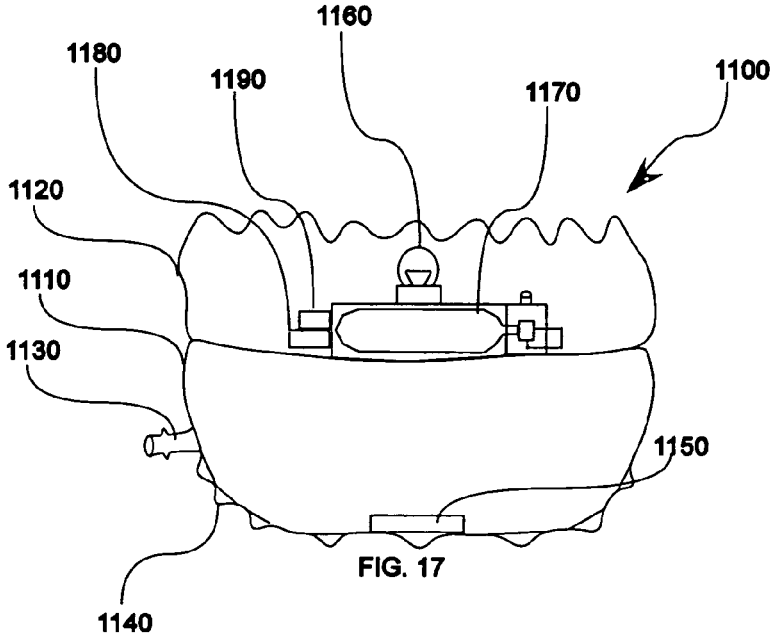
FIG. 17 is a partial cross-sectional side view of another safety marker in accordance with an embodiment of the present invention.

Referring to FIG. 17, an alternative embodiment of a safety marker 1100 is shown. Specifically, the safety marker 1100 can have an inflatable visual indicator 1120 that may be cylindrical, conical, or rectangular when inflated. The base 1110 can have a port 1130 for filling the base with displaceable material. The base also has ridges 1140 formed in the bottom that slow the safety markers travel by providing friction points with the roadway. Inside the base is an impact switch 1150 that engages when the safety marker impacts another surface. The switch can engage a light 1160 and a compressible gas source 1170 to inflate the visual indicator. A battery power source 1180 is attached to the light. Alternatively, a radio frequency receiver 1190 can be used to activate the light and gas source.

Figure 18:
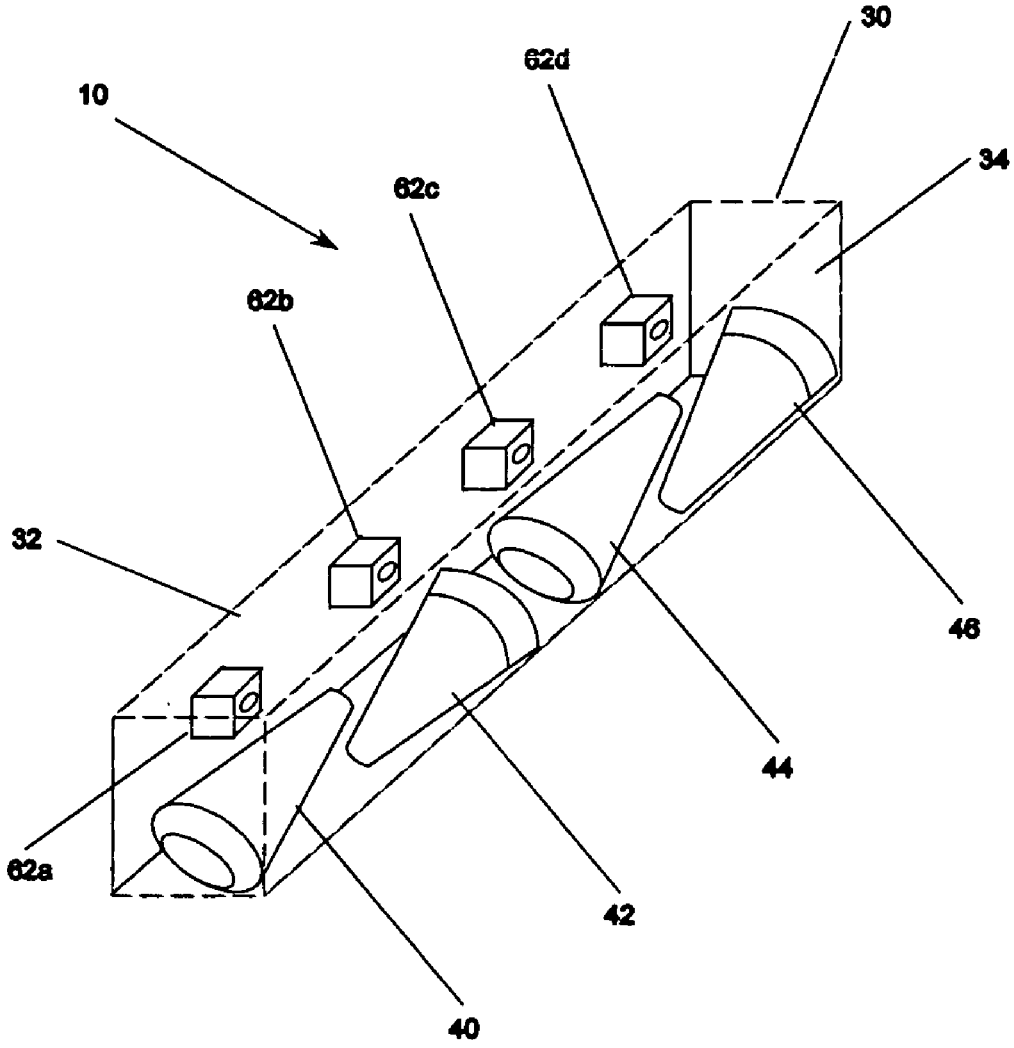
FIG. 18 is a perspective schematic view of another safety marker deployment system in accordance with an embodiment of the present invention.

Referring to FIG. 18, an alternative embodiment of the safety marker deployment system ejectors is shown. The safety marker deployment system 10 can include a plurality of sequential ejectors 62*a–b*, each associated with one of the plurality of safety markers 40*a–d* to sequentially deploy the safety markers from the container. The ejectors 62*a″d* can be electronic solenoids, pneumatic solenoids, hydraulic rams, pneumatic rams, trap doors, magnetic switches, gravity assist hooks, and a burst of localized compressed gas In another embodiment, the safety marker deployment system can be actuated by electronic devices such as a solenoid, as described above. The electronic devices can be computer controlled to match the deployment rate and speed of the safety markers with the acceleration, deceleration, or speed of the vehicle. Thus the computer can control the spacing and arrangement of the safety markers during deployment.

In another embodiment, the safety markers are contained in multiple containers 36*a–d* as shown in FIGS. 1 and 2. The containers could be cubic or cylindrical tubes arranged across the rear end of the vehicle. Each container can be mounted at a specific angle with respect to the vehicle and roadway such that the safety markers can be ejected into a pattern that is wider than the vehicle. Additionally, the angle of the containers could be adjustable such that a computer could control the angle and thereby determine and control the trajectory of each safety marker upon ejection. This embodiment provides the advantage of being able to deploy the safety markers in a smaller space than deployment during vehicle motion. It also allows all the safety markers to be deployed simultaneously but still have a v-shaped pattern after deployment.

In another alternative embodiment, the safety marker deployment system can be configured to only partially deploy the safety markers. This provides the advantages of ease of access to the markers while still in the vehicle and facilitates manual placement of the safety markers. Additionally, other objects, such as fire extinguishers, flares, or other suitable emergency equipment might be used in lieu of the safety markers, thus providing quick and easy access to such equipment when partially deployed.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A safety marker deployment system configured to be mounted to a motor vehicle, comprising:

a. at least one container, mountable to the vehicle;

b. a plurality of safety markers, removably disposed in the at least one container and with the safety markers disposed laterally adjacent one another in a laterally pre-positioned array substantially corresponding to a subsequent desired lateral position on a roadway; and c. a plurality of sequential ejectors, coupled to the at least one container, each ejector corresponding to and positioned adjacent a different one of the plurality of safety markers, to sequentially deploy the safety markers, while the vehicle is moving, in a longitudinal configuration substantially corresponding to a desired longitudinal position on the roadway, so that the safety markers are deployed in a predetermined lateral and longitudinal configuration.

2. A safety marker deployment system in accordance with claim 1, further comprising:

a. a lid, moveably coupled to the at least one container and movable to an open position; and b. a releasable lid latch, operatively coupled to the lid and the at least one container, configured to open the lid from a closed position.

3. A safety marker deployment system in accordance with claim 2, further comprising:

a. a remote actuator, operatively coupled to the ejectors and lid latch.

4. A safety marker deployment system in accordance with claim 3, wherein the remote actuator is selected from the group consisting of:

a. an electronic switch,
b. a microprocessor relay,
c. a pneumatic switch,
d. an electro-hydraulic switch,
e. a hydraulic lever arm,
f. a radio transmitter,
g. an infrared transmitter,
h. an acoustic transmitter, and
i. a cable.

5. A safety marker deployment system in accordance with claim 1, wherein the plurality of ejectors further comprises:

a. a plurality of spaced apart flaps, pivotally coupled to the container, each flap positioned to engage a different one of the plurality of safety markers to eject the safety marker from the at least one container;
b. each flap having a tab with the tabs being disposed at different distances from the flaps; and
c. a plurality of fingers, attached to and pivotal with a pivot rod extending across the container, each finger corresponding to a different tab so that as the rod pivots, the fingers sequentially engage the tabs and the flaps in sequence to deploy the safety markers.

6. A safety marker deployment system in accordance with claim 5, wherein the plurality of ejectors further comprises:

a. a pivot rod lever, coupled to the pivot rod, configured to move through a predetermined angle, and to rotate the pivot rod as the lever moves through the predetermined angle;
b. a main lever, pivotally coupled with respect to the at least one container, having an unengaged positioned and an engaged position wherein the main lever engages the pivot rod lever in the engaged position;
c. a biasing device, coupled between the main lever and the container, biasing the lever to the unengaged position; and
d. an actuator cable, coupled between the main lever and the actuator, configured to pivot the main lever toward the engaged position wherein the pivot rod lever will rotate the pivot rod upon contact with the main lever.

7. A safety marker deployment system in accordance with claim 6, wherein the remote actuator further comprises:

a. a handle, operatively coupled to the actuator cable wherein the handle pulls the actuator cable thereby actuating the plurality of sequential ejectors of the automatic safety marker deployment system; and
b. a mounting bracket operatively coupled to the handle and configured to be attached to a motor vehicle such that the operator of the motor vehicle can operate the handle while sitting in the driver seat of the vehicle.

8. A safety marker deployment system in accordance with claim 6, further comprising:

a. a lid, moveably coupled to the at least one container and movable to an open position; and
b. a releasable lid catch, operatively coupled to the lid and the at least one container, having a locked position and an open position, the lid catch being biased to the locked position by a biasing device selected from the group consisting of:
   i. the main lever when the main lever is biased to the unengaged position,
   ii. an electric solenoid, and
   iii. a pneumatic solenoid.

9. A safety marker deployment system in accordance with claim 1, wherein the plurality of sequential ejectors further comprises an actuator, operatively coupled to a plurality of spaced apart flaps, with each flap positioned to engage a different one of the plurality of safety markers to eject the safety marker from the at least one container, the actuator selected from the group consisting of:

a. an electric solenoid,
b. a radio controlled solenoid,
c. a pneumatic ram,
d. a hydraulic ram,
e. an electric linear actuator,
f. an electric rotary actuator, and
g. a cable.

10. A safety marker deployment system in accordance with claim 1, wherein the plurality of sequential ejectors is selected from the group consisting of:

a. a compressed gas,
b. electronic solenoids,
c. radio controlled solenoids,
d. electric linear actuators,
e. electric rotary actuators,
f. pneumatic solenoids,
g. hydraulic rams,
h. pneumatic rams,
i. trap doors,
j. magnetic switches,
k. composite material plates, and
l. angled metal plates.

11. A safety marker deployment system in accordance with claim 1, further comprising:

a. a retrieval tether line operatively coupled to the safety markers and the container.

12. A safety marker deployment system in accordance with claim 11, further comprising an automated retrieval mechanism, coupled to the retrieval tether line, selected from the group consisting of:

a. a pneumatic motor,
b. an electric motor, and
c. a manually operated reel.

13. A safety marker deployment system in accordance with claim 1, wherein each of the plurality of safety markers includes:

a. a compliant compartment;
b. a displaceable material, disposed in the compliant compartment; and
c. a visual indicator, extending upwardly from the compliant compartment.

14. A safety marker deployment system configured to be mounted to a motor vehicle, comprising:

a. at least one container, mountable to the vehicle;
b. a plurality of safety markers, removably disposed in the at least one container and with the safety markers disposed laterally adjacent one another in a laterally pre-positioned array substantially corresponding to a subsequent desired lateral position on a roadway; and
c. means for sequentially deploying the plurality of safety markers directly from the laterally pre-positioned array while the vehicle is moving, to a longitudinal position behind the vehicle so that, together with the laterally pre-positioned array, the safety markers form a predetermined lateral and longitudinal configuration to direct traffic or warn drivers.

15. A safety marker deployment system in accordance with claim 14, wherein each of the safety markers further comprise:

a. means for dissipating impact energy upon impact with the roadway to resist undesired lateral movement upon impact with the roadway.

16. A safety marker deployment system in accordance with claim 14, wherein each of the safety markers further comprise:

a. means for self-orienting the safety markers into a substantially upright position.

17. A method of directing traffic or warning drivers on a roadway, comprising the steps of:

a. loading a plurality of safety markers into at least one container on a vehicle so that the safety markers are positioned laterally adjacent one another in a laterally pre-positioned array across a width of the vehicle substantially corresponding to a desired lateral position on a roadway;

b. driving the vehicle on the roadway;

c. actuating a plurality of sequential ejectors, each ejector associated with a different one of the markers, to sequentially eject the safety markers, while the vehicle is moving, behind the vehicle in a predetermined lateral and longitudinal configuration with respect to the roadway.

18. A method in accordance with claim 17, further comprising the steps of:

a. closing a lid, moveably coupled to the at least one container, to secure the safety markers; and b. actuating a releasable lid latch, coupled between the lid and the at least one container, to open the container prior to safety marker deployment.

19. A safety marker deployment system configured to be mounted to a motor vehicle, comprising:

a. at least one container, mountable to the vehicle;

b. a plurality of paired safety markers and ejectors disposed laterally adjacent one another in the at least one container in a laterally pre-positioned array substantially corresponding to a subsequent desired lateral position of the safety markers on a roadway; and c. the plurality of sequential ejectors configured to sequentially deploy the safety markers, while the vehicle is moving, in a longitudinal configuration substantially corresponding to a desired longitudinal position on the roadway, so that the safety markers are deployed in a predetermined lateral and longitudinal configuration.

20. A system in accordance with claim 19, further comprising a motor vehicle configured to carry the at least one container wherein the safety markers are disposed across a width of the vehicle.

* * * * *